US006564428B2

(12) United States Patent
Richard et al.

(10) Patent No.: US 6,564,428 B2
(45) Date of Patent: May 20, 2003

(54) COMPOUND HINGE

(75) Inventors: John E. Richard, Rogers, MN (US); Craig E. Schinzel, Ramsey, MN (US); Wallace H. Polzin, Ramsey, MN (US); Clifford A. Klinger, Minneapolis, MN (US); William J. Nepsha, Blaine, MN (US); Marvin J. Thibodeau, Elk River, MN (US)

(73) Assignee: Hoffman Enclosures, Inc., Anoka, MN (US)

( * ) Notice: Subject to any disclaimer, the term of this patent is extended or adjusted under 35 U.S.C. 154(b) by 0 days.

(21) Appl. No.: 09/759,650

(22) Filed: Jan. 12, 2001

(65) Prior Publication Data

US 2002/0004969 A1 Jan. 17, 2002

Related U.S. Application Data

(60) Provisional application No. 60/188,596, filed on Jan. 14, 2000.

(51) Int. Cl.[7] ..... E05D 3/06

(52) U.S. Cl. ..... 16/366; 16/375; 16/374; 16/335; 16/342; 16/371

(58) Field of Search ..... 16/366, 342, 375, 16/374, 335, 371; 220/817, 831, 832, 844, 848

(56) References Cited

U.S. PATENT DOCUMENTS 4,114,236 A * 9/1978 Vandervort ..... 16/142
4,329,759 A * 5/1982 Lautenschlager ..... 16/335
4,684,017 A * 8/1987 Watanabe et al. ..... 206/235
4,928,350 A * 5/1990 Morgan ..... 16/297
5,233,726 A * 8/1993 Cress ..... 16/336
5,282,293 A * 2/1994 Pedoeem ..... 16/342
5,493,760 A * 2/1996 Takimoto ..... 16/366
5,685,046 A * 11/1997 Neag et al. ..... 16/366
5,893,481 A * 4/1999 Favre ..... 220/831
5,915,441 A * 6/1999 Schlack ..... 16/371
5,943,739 A * 8/1999 Vandergriff ..... 16/366
6,092,690 A * 7/2000 Bitowft et al. ..... 220/831
6,151,755 A * 11/2000 Rozema ..... 16/361

* cited by examiner

*Primary Examiner*—Anthony Knight
*Assistant Examiner*—Lisa Bannapradist
(74) *Attorney, Agent, or Firm*—Merchant & Gould PC

(57) ABSTRACT

A compound hinge system includes a first link and a second link. The first link includes knuckles and arcing engaging surfaces next to stop portions that are configured for receiving engaging lug portions on a second link member. A second link member includes first and second sets of knuckles. One of the sets of knuckles cooperates with a hinged pin to pivot relative to the first link while the second set of knuckles receives a hinge pin to pivot relative to the second element. The lugs slide relative to the engaging surface and push against the stop portions to flex them outward and require additional force to move between various stops in the range of motion.

29 Claims, 12 Drawing Sheets

FIG. 1
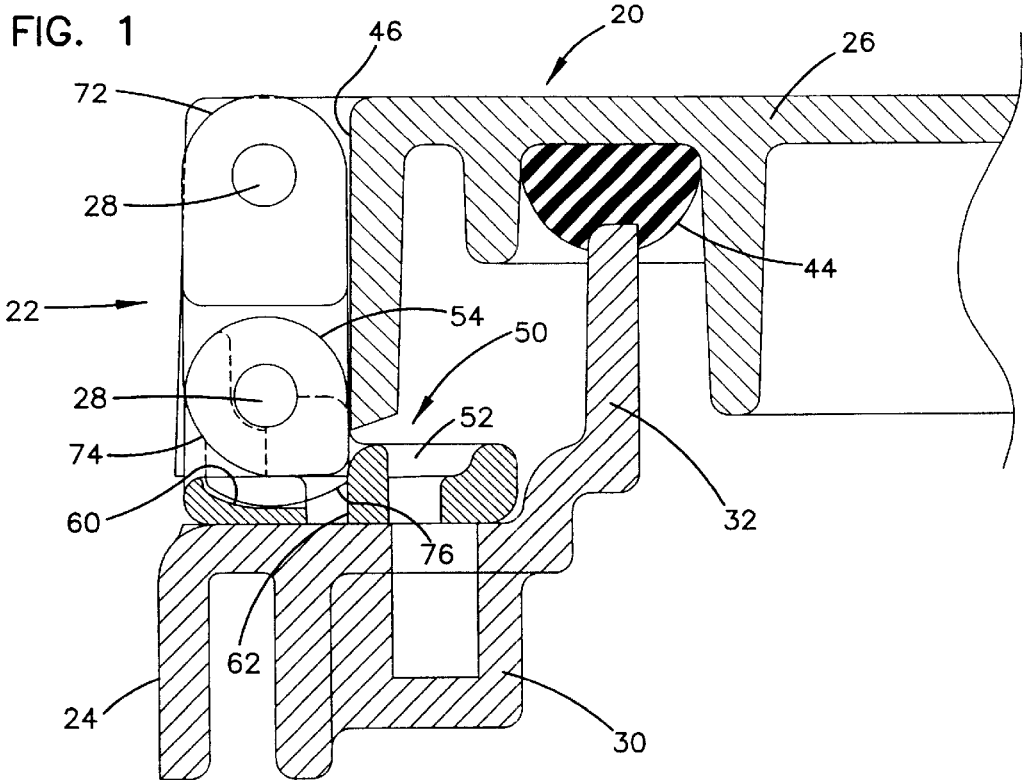
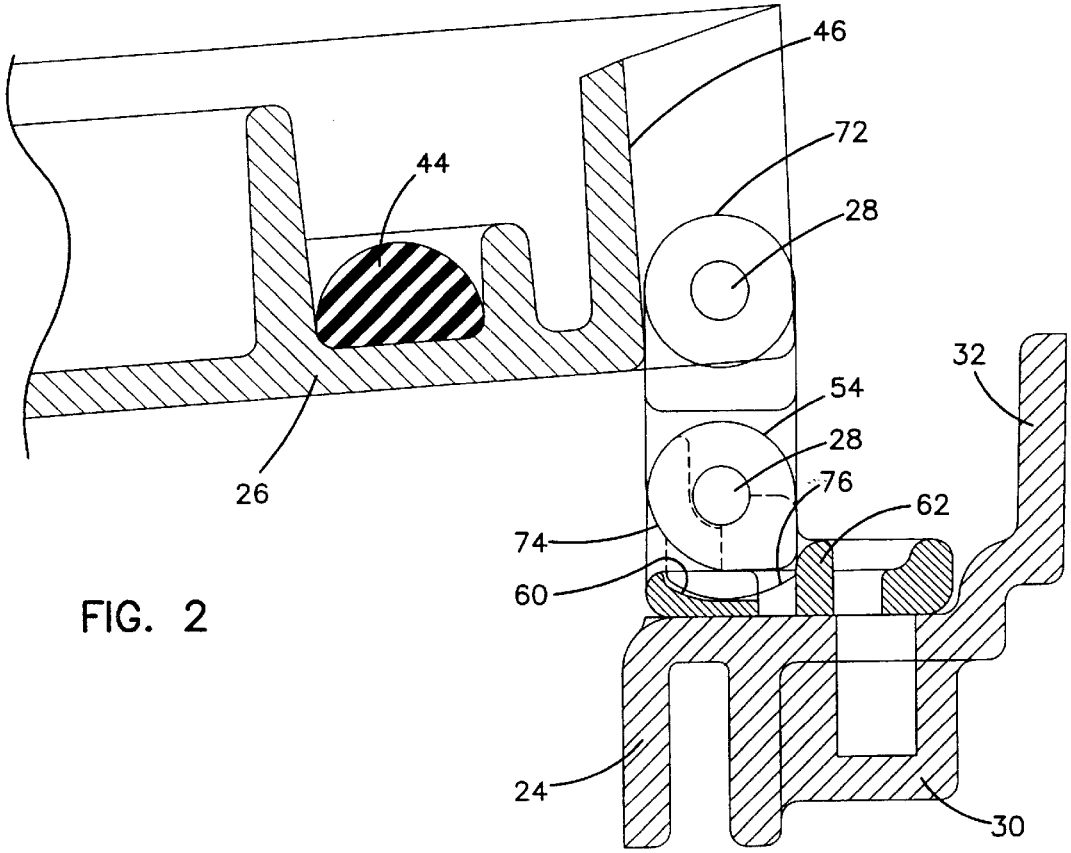
FIG. 2

FIG. 13
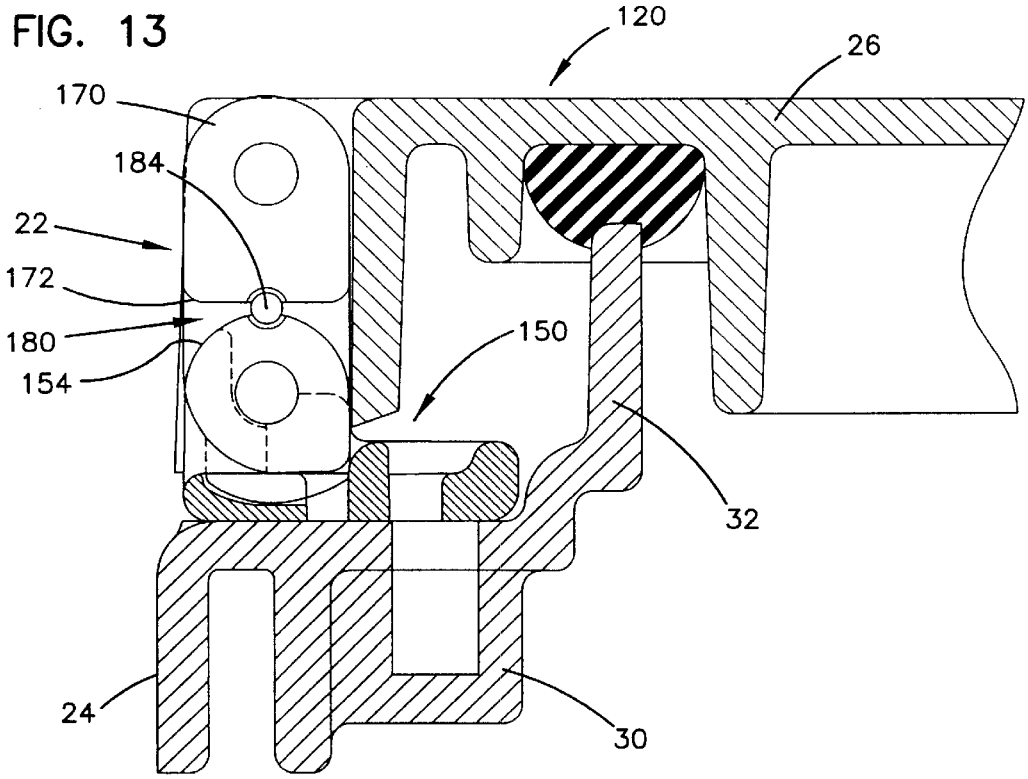
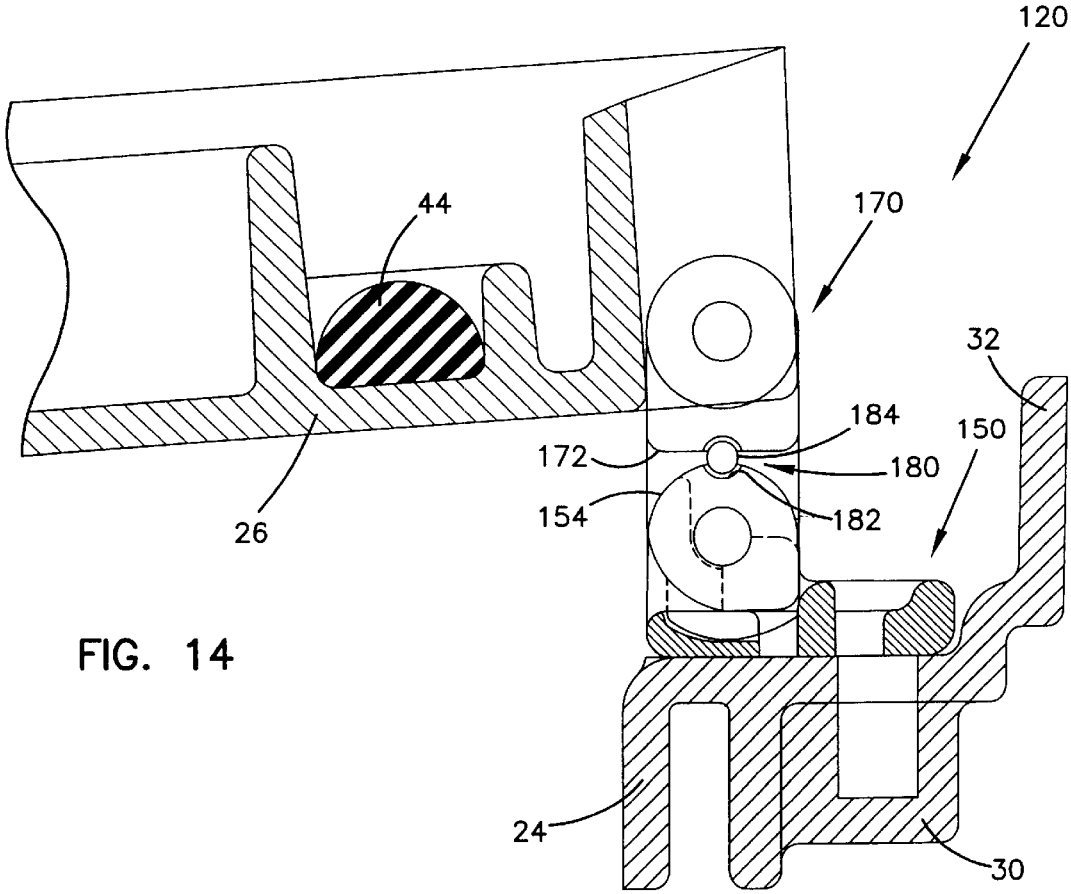
FIG. 14

COMPOUND HINGE

This application claims priority from Provisional Application Ser. No. 60/188,596 filed Jan. 14, 2000, which is incorporated herein by reference.

BACKGROUND

1. Field

The present invention is directed to a hinge, and in particular, to a hinge providing two pivot axes for two degrees of movement and greater range of motion.

2. Prior Art

Enclosures utilize hinges on covers or doors to provide access to the interior of the enclosure. Hinges often mount along the side of the enclosure so that the door does not close under its own weight. It can be appreciated that a device for preventing an enclosure door from closing and swinging freely would be advantageous to provide access to the interior of the enclosure for an extended period of time. Normal door and hinge construction often do not have closure devices and the balance and weight of the door prevent accidental closure. However, in some instances, it may be advantageous to have a door that includes a structural stop that allows opening and closing, but requires greater force to close so that the door may be held in an open position. This is especially important in outdoor conditions where wind may engage the planar surface area of the door and tend to open or close a door. Another common problem with doors and the hinges is providing sufficient mobility to the cover. In hinge and door combinations wherein the door opens only approximately 180 degrees, the door is extended away from the enclosure and as it is exposed, the door may be subject to closure from the wind or may endure forces in an opposite direction to closing that may cause damage to the hinge or even break off the hinge. This situation also occurs in enclosures having a cover on the top that opens and the door lies substantially horizontal and exposed in the open position. Although there are doors that open to a greater range of motion, workers often will place objects on the door or lean on the door in the open position, often damaging the hinge or breaking the door.

Door and hinge systems are known that provide a greater range of motion. However, such systems typically require special mounting arrangements and decrease the utility or the exterior appearance. Such systems may also limit the access to the interior of the enclosure. In addition, the systems do not provide any resistance to the door closing, so that the door may still accidentally swing shut such as when exposed to wind forces. Further disadvantages of such systems are the type of motion required often causes damage to gaskets that are wiped or rubbed by the cover during some portion of the opening and closing motion.

It can be seen then that a new and improved closure and hinge system is needed. Such a system should provide free range of motion so that the door may open against the side of the closure to minimize wind effect. Such a system should also provide resistance to accidental closure and provide a range of motion that does not damage or wear gaskets on the enclosure cover. The present invention addresses these as well as other problems associated with enclosures and hinges.

SUMMARY OF THE INVENTION

The present invention relates to a hinge, and in particular to a compound hinge, that provides two axes of rotation and a wide range of motion between the hinged elements.

The compound hinge includes a first base hinge link mounting to a first element. The first link includes raised knuckle portions for receiving a hinge pin therethrough. The base portion has recesses formed therein for receiving mounting devices such as screws or bolts for attachment to the first element. Intermediate the knuckles are arcing surfaces configured for receiving and aligning lug portions of a second link. The receiving portions are proximate a pair of opposed stop members that flex slightly and are flexed when pushed by the corresponding lugs. The stop portions act as a toggle to retain the hinge in position. The knuckles may also include stop portions for positioning the second link relative to the first link. A second link includes two sets of knuckles for receiving hinge pins. The first knuckle is configured for aligning with and having orifices coaxial with the knuckles of the first link. The second link is aligned so that the first set of knuckles and second set of knuckles are parallel with lugs extending substantially perpendicular to and aligned with the axes of the knuckles. The lugs are configured to extend into the receiving portions of the first link. The first knuckle is aligned with the knuckles of the first element and the second set of knuckles on the second link receive the pin for attaching to the second element. In this manner, the second link is hinged relative to the first link and the second link is also hinged relative to the second element. The first knuckle also includes complementary stop portions cooperating with the stop portions of the knuckles of the first link to limit relative rotation. The knuckles may also form a toggle device in one embodiment, providing further rotational resistance at a predetermined rotational position.

When assembled, the lugs engage the receiving surface and are held in place by the stop portions of the base on the first link member. As the cover or door is opened and rotated relative to a second link, it will reach its full range of motion, but it will be possible to open the door further relative to the first element, such as a housing. At this point, continued rotation will press the lugs against the stop elements and cause the stop elements to flex slightly until the lugs push beyond the stop elements. The second hinge member is then free to rotate relative to the first hinge member and an additional range of rotation is achieved.

To close the hinge, the second element rotates relative to the second hinge member, wherein the complementary stop portions engage and resist rotation. However, as further rotation occurs and the second element reaches its full range of motion relative to the second hinge member, further rotation of the second element causes the lugs to flex the stop elements and allow the lugs to push past the stop portions and return to the original position.

The arrangement of the present invention provides a simple, reliable hinge that provides a wide range of motion. In addition, the toggling effect from the lugs engaging the stop elements act as a retainer to hold the door in either the opened or closed position. However, with continued pressure, the door can be easily closed. The present invention is easy to assemble and can be retrofitted to other existing door and enclosures.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in that there is illustrated and described a preferred embodiment of the invention.

BRIEF DESCRIPTION OF THE DRAWINGS

FIG. 1 shows an end sectional view of a compound hinge according to the principles of the present invention in a closed position;

FIG. 2 shows an end sectional view of the hinge shown in FIG. 1 in a partially open position;

FIG. 13 shows an end sectional view of a second embodiment of a compound hinge according to the principles of the present invention in a closed position;

FIG. 14 shows an end sectional view of the hinge shown in FIG. 13 in a partially open position;

DETAILED DESCRIPTION OF THE PREFERRED EMBODIMENTS

Figure 3:
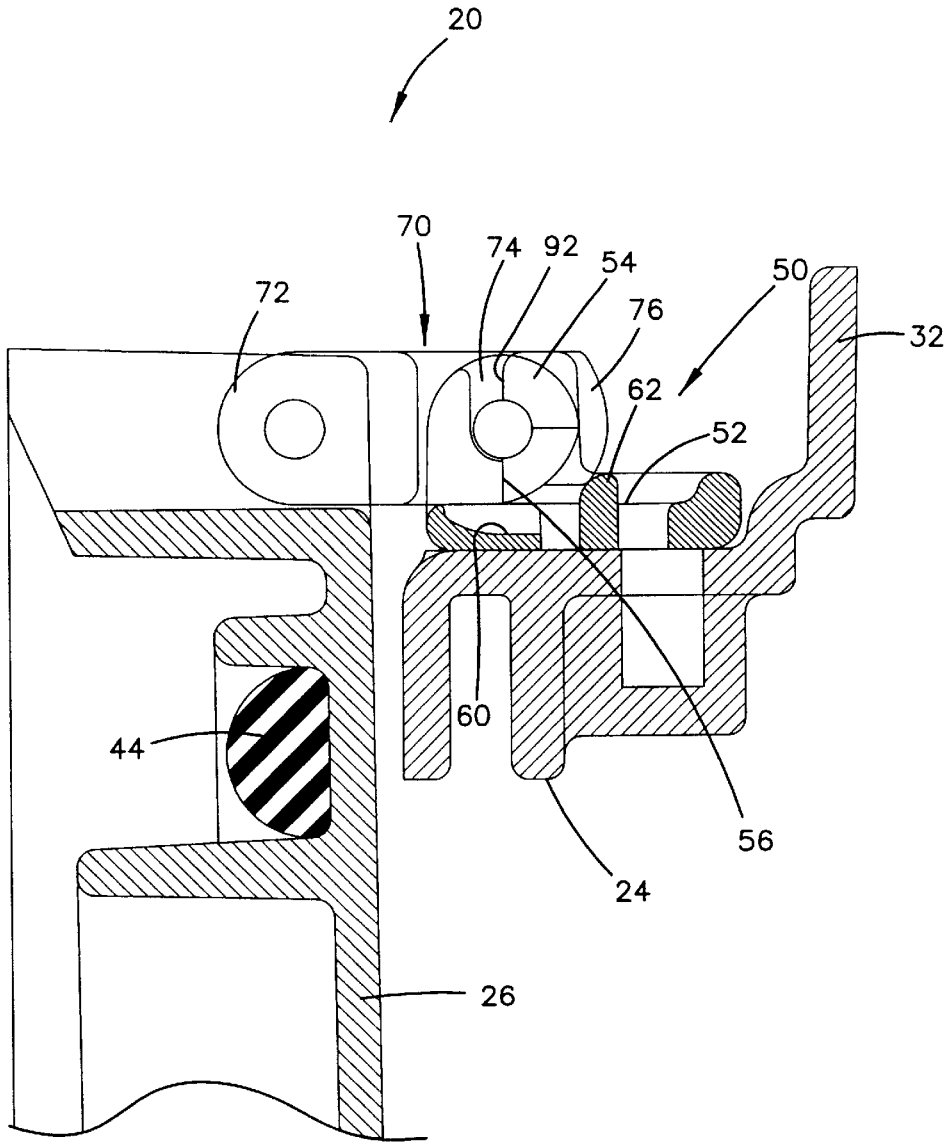
FIG. 3 shows an end sectional view of the hinge shown in FIG. 1 in a fully open position.
Figure 4:
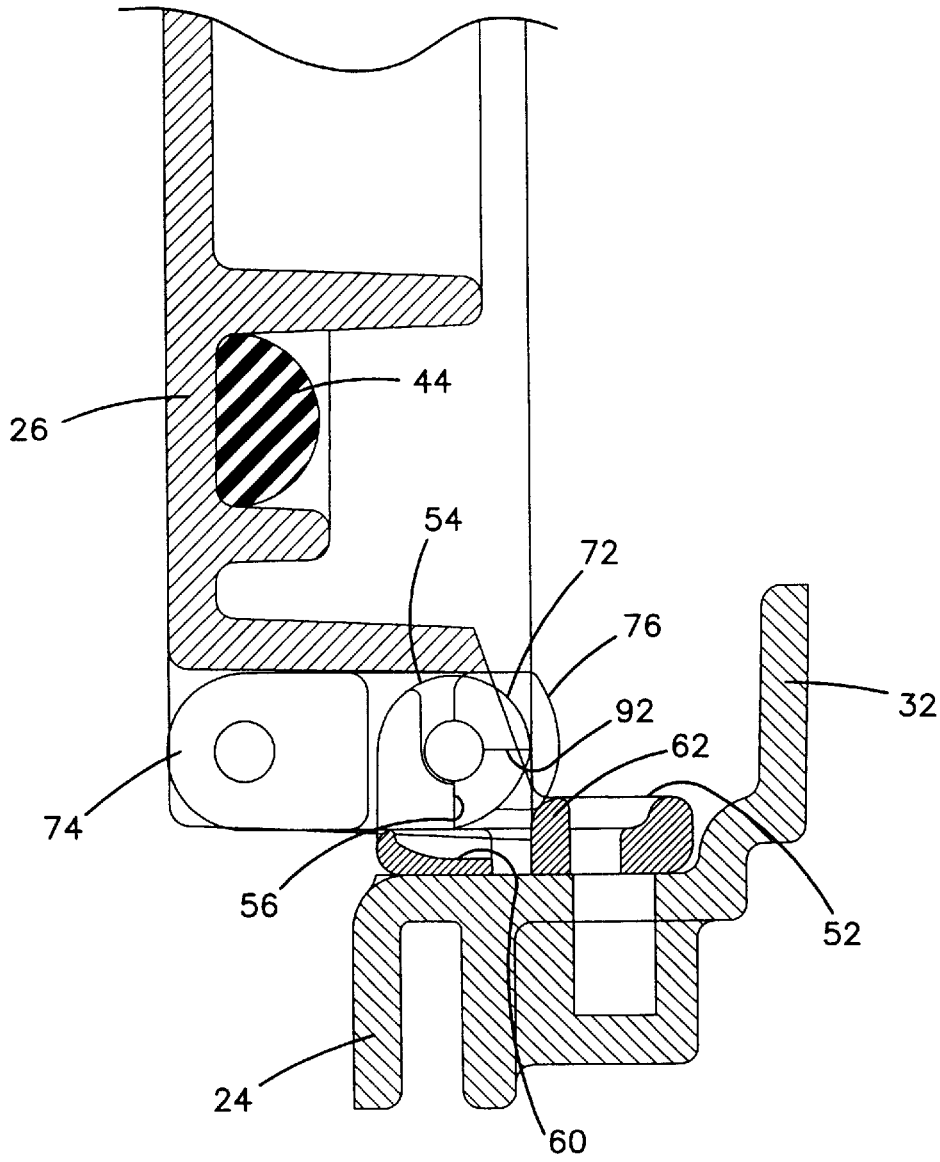
FIG. 4 shows an end sectional view of the hinge shown in FIG. 1 in a partially open position.

Referring now to the Figures, and in particular to FIG. 1, there is shown a portion of an enclosure 20 having a compound hinge 22. The hinge 22 pivotally connects a cover or door 26 to a housing 24. As shown in FIGS. 2–4, the compound hinge 22 provides two separate axes of rotation, providing a greater range of motion and freedom of movement between the door 26 and the housing 24.

Figure 9:
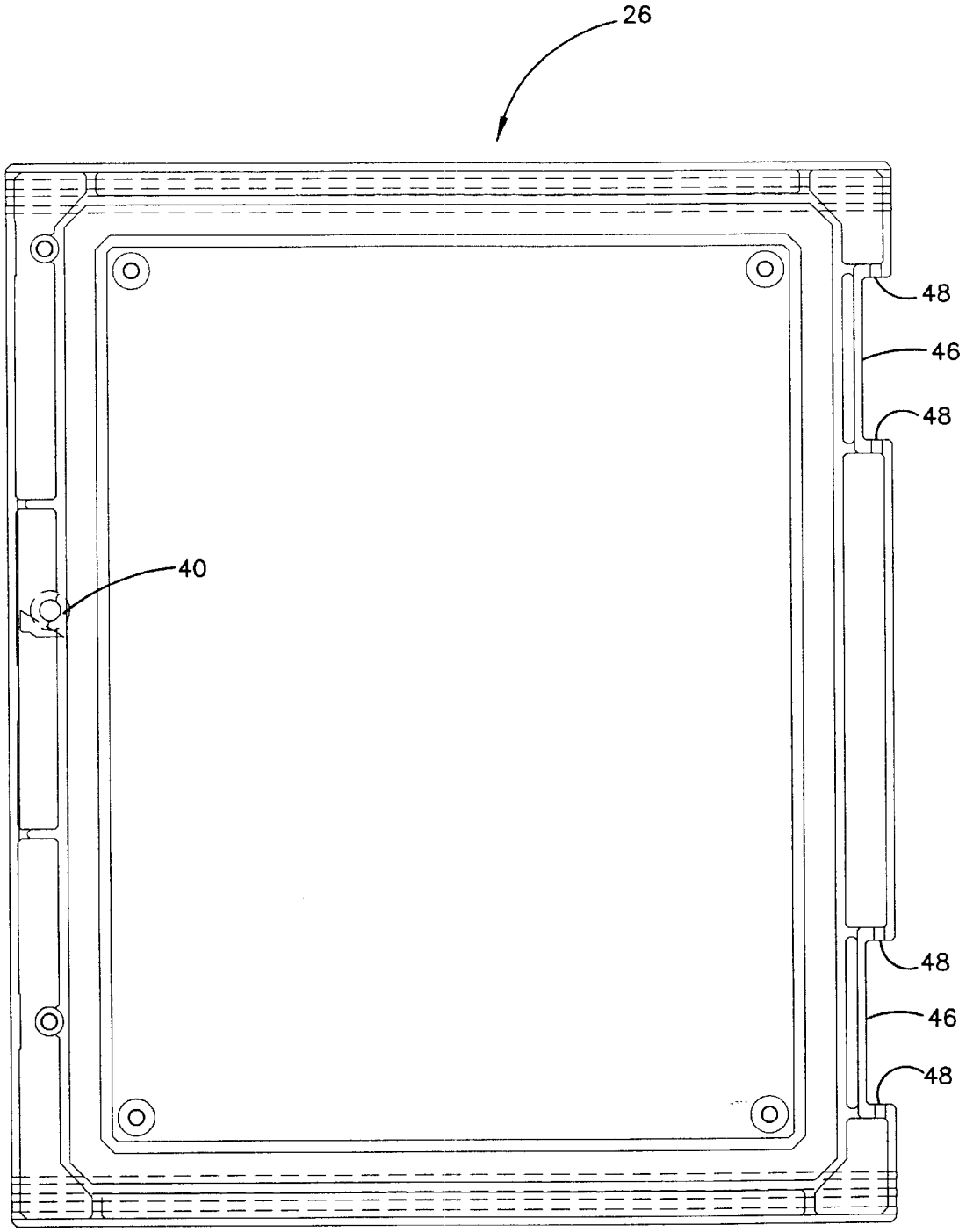
FIG. 9 shows a bottom plan view of a door for an enclosure according to the principles of the present invention.
Figure 10:
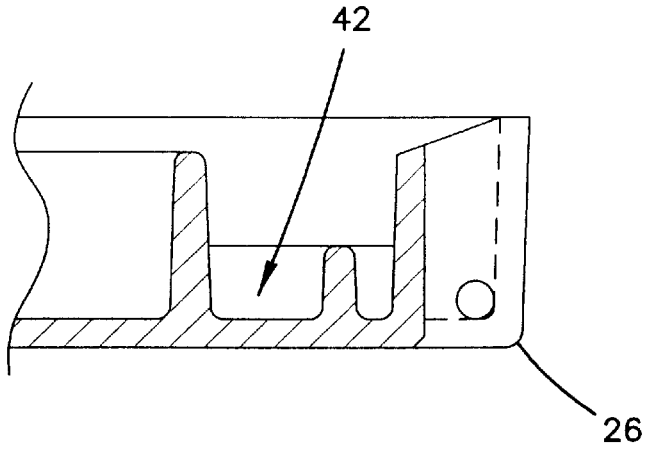
FIG. 10 shows a sectional view of the door taken along line 10—10 of FIG. 9.

Referring now to FIG. 9, the door 26 is shown in greater detail. The door typically includes bracing around the periphery thereof, the door forms a channel 42 receiving a gasket 44, as shown in FIG. 10, for forming a seal with the housing 24, as shown in FIG. 1. As shown in FIG. 9, the cover includes recesses 46 formed along one edge of the door 26 for mounting the hinge 22 and aligned bores 48 for receiving a hinge pin 28 (not shown in FIG. 9) for providing pivotal movement between the hinge 22 and the door 26. Along the opposite edge of the door 26 is a latch 40.

Figure 12:
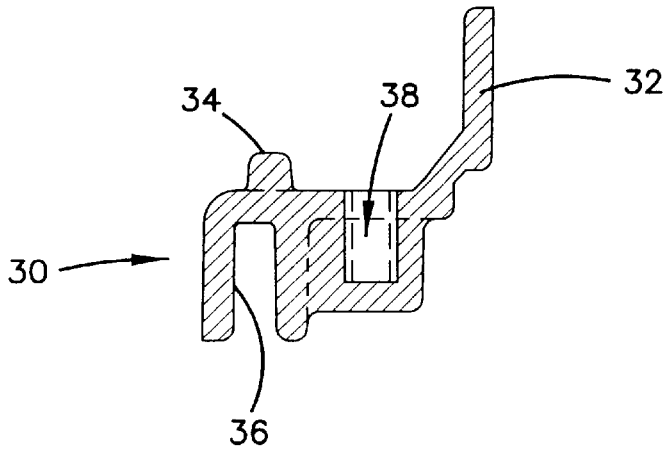
FIG. 12 shows a sectional view of the enclosure taken along line 12—12 of FIG. 11.
Figure 11:
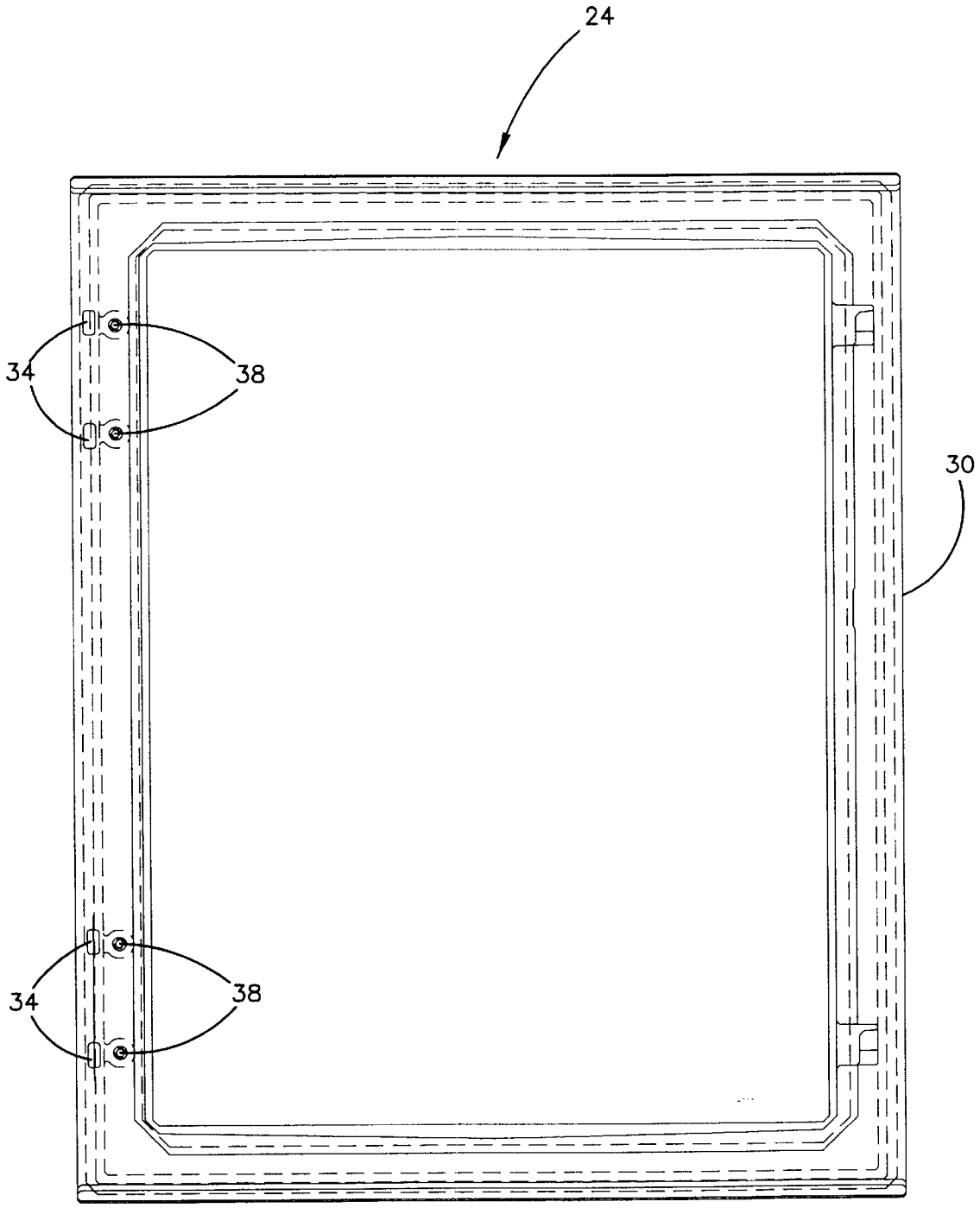
FIG. 11 shows a top plan view of an enclosure according to the principles of the present invention.
Figure 15:
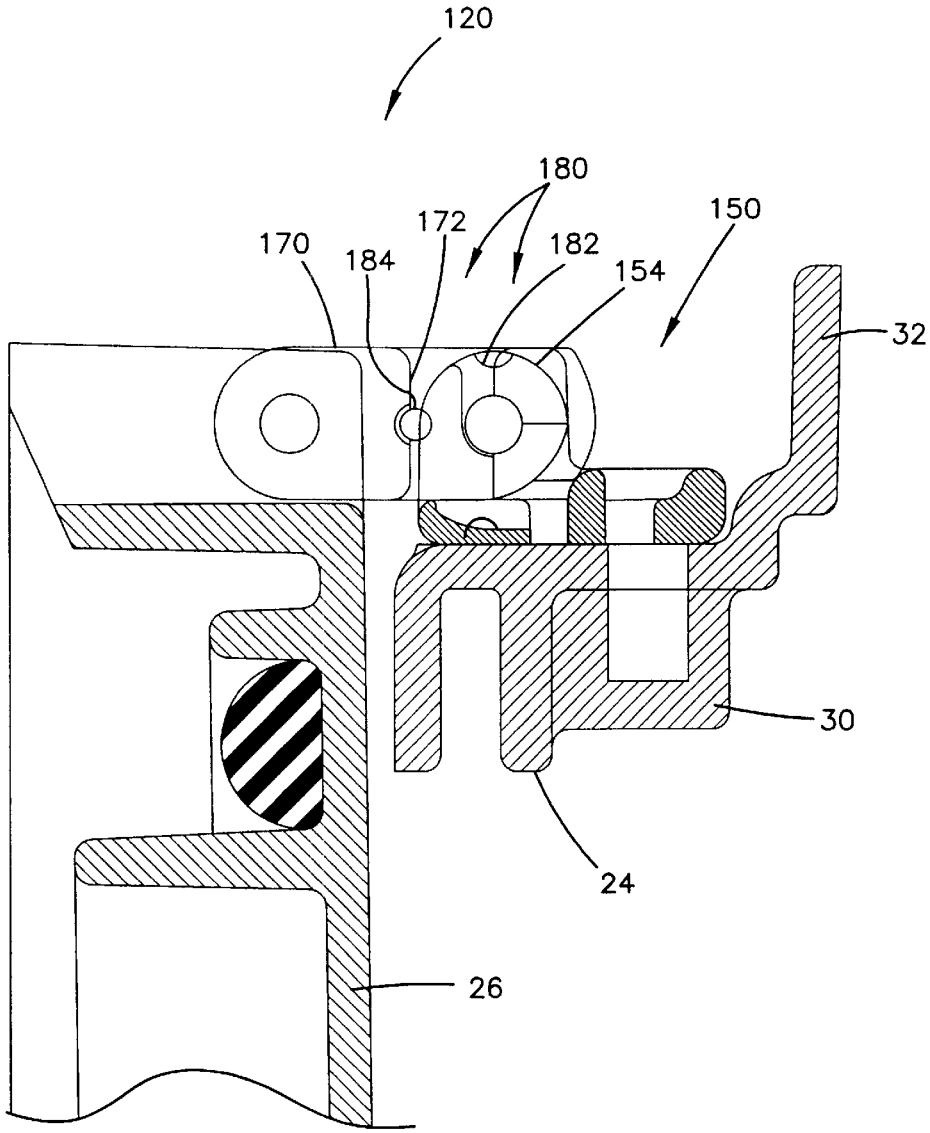
FIG. 15 shows an end sectional view of the hinge shown in FIG. 13 in a fully open position.
Figure 16:
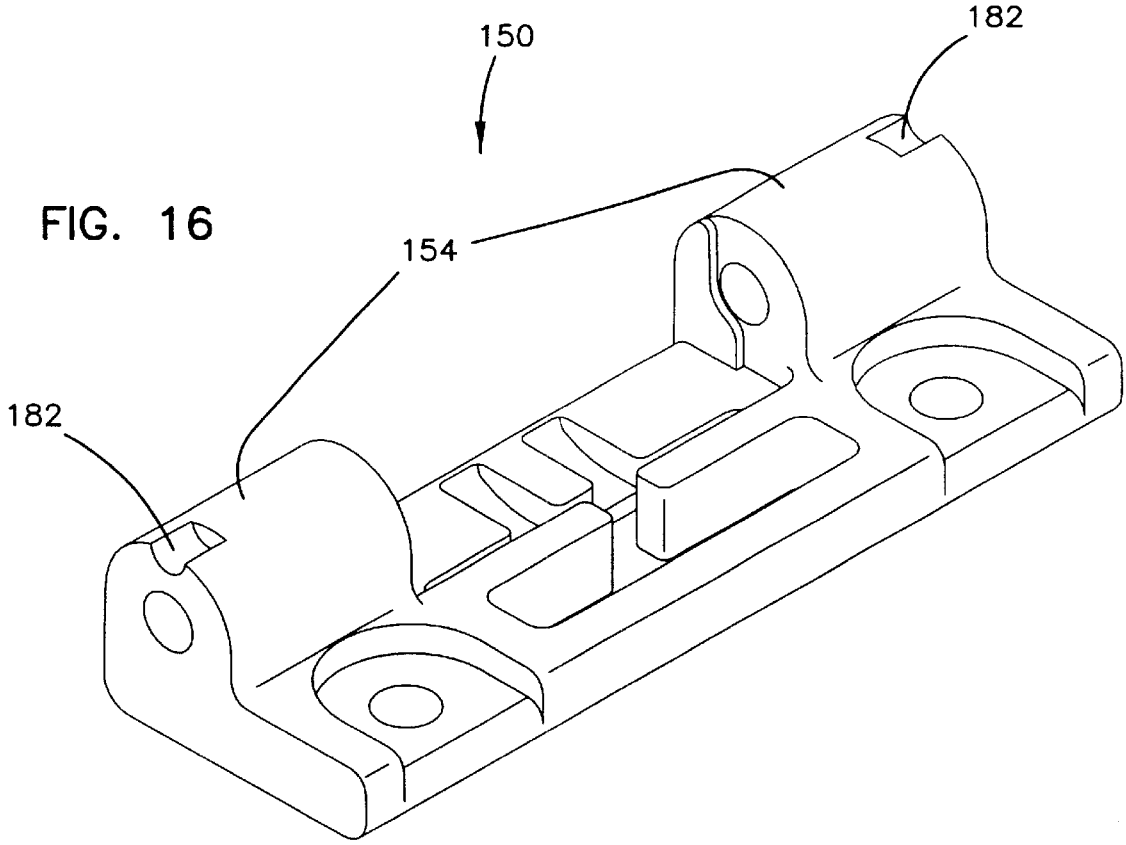
FIG. 16 shows a perspective view of a first link for the compound hinge shown in FIG. 13.
Figure 17:
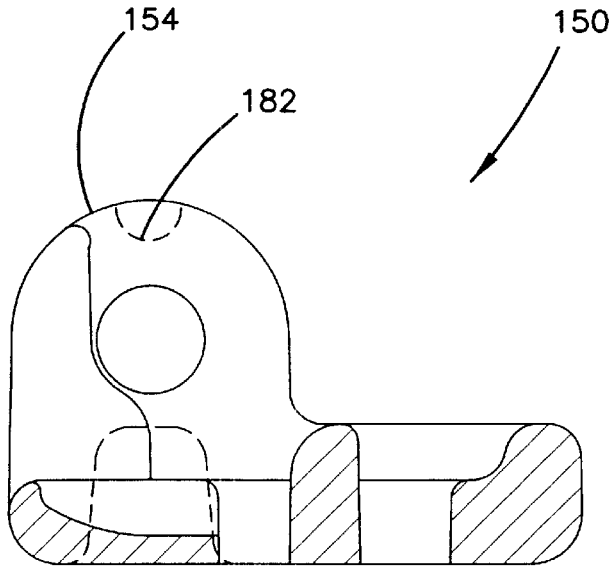
FIG. 17 shows a sectional view of the first link taken along line 17—17 of FIG. 16.

Referring now to FIGS. 11 and 12, the door receiving portion of the housing or enclosure 24 is shown. Although the housing 24 may be a molded monolithic element, it may include a collar 30 forming a rectangular opening fitting against upper edges of sides of the housing 24, as shown in FIG. 12. The collar 30 includes an inner ridge 32 that extends upward and engages the gasket 44 in the closed position, as shown in FIG. 1.

The collar 30 also may include mounting holes 38 and alignment studs 34 that engage the base of the first link member, as explained hereinafter. The collar 30 also forms a channel 36 that inserts over the top of the wall edges of the housing 24.

Figure 5:
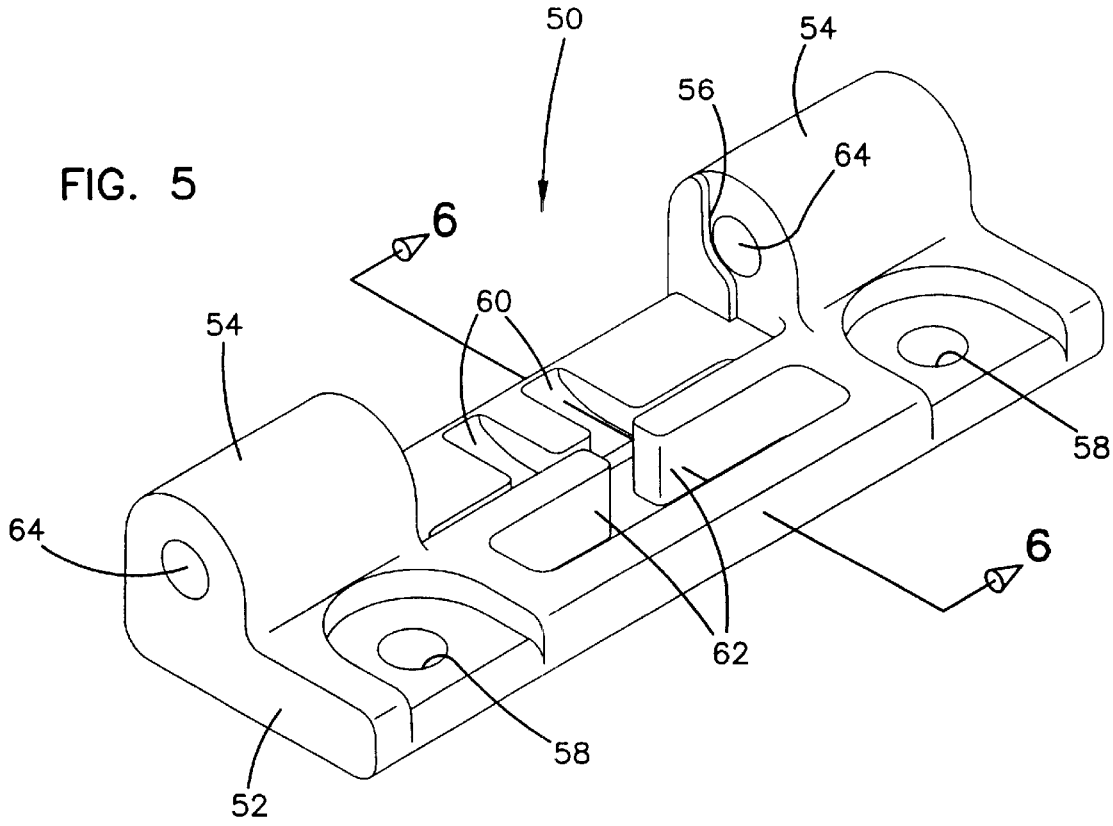
FIG. 5 shows a perspective view of a first link for the compound hinge shown in FIG. 1.
Figure 6:
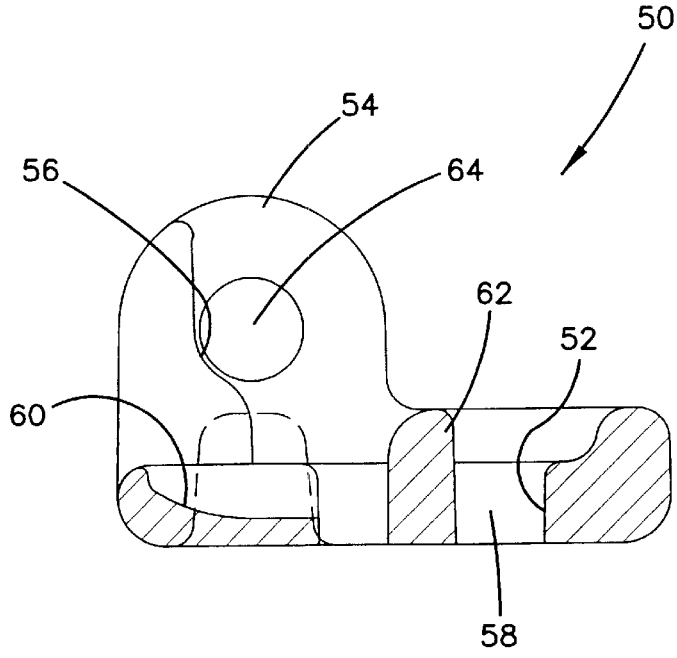
FIG. 6 shows a sectional view of the first link taken along line 6—6 of FIG. 5.

Referring now to FIGS. 5 and 6, a first link member 50 is shown. The first link member 50 includes a base portion 52 having a pair of mounting holes 58 formed therethrough. The mounting holes 58 are aligned even with first hinge knuckles 54 that are coaxially aligned to receive a hinge pin 28. The first knuckles 54 include stop portions 56 of about 90 degrees. The radially extending end surfaces of the stop portions 56 cooperate with complementary surfaces on a second link member, as explained hereinafter. Intermediate the first knuckles 54 are lug receiving recesses 60 formed in the base portion 52. The lug receiving recesses 60 are receive the corresponding lugs of the second link, as explained hereinafter. Stop fingers 62 are spaced apart from the lug receiving recesses 60. The stop fingers 62 act as a surface engaging the lugs. With spaces on both sides of the fingers 62 and with the fingers being attached at only one end, the fingers 62 flex, allowing the lugs to toggle so that the second link may rotate, as explained hereinafter.

Figure 7:
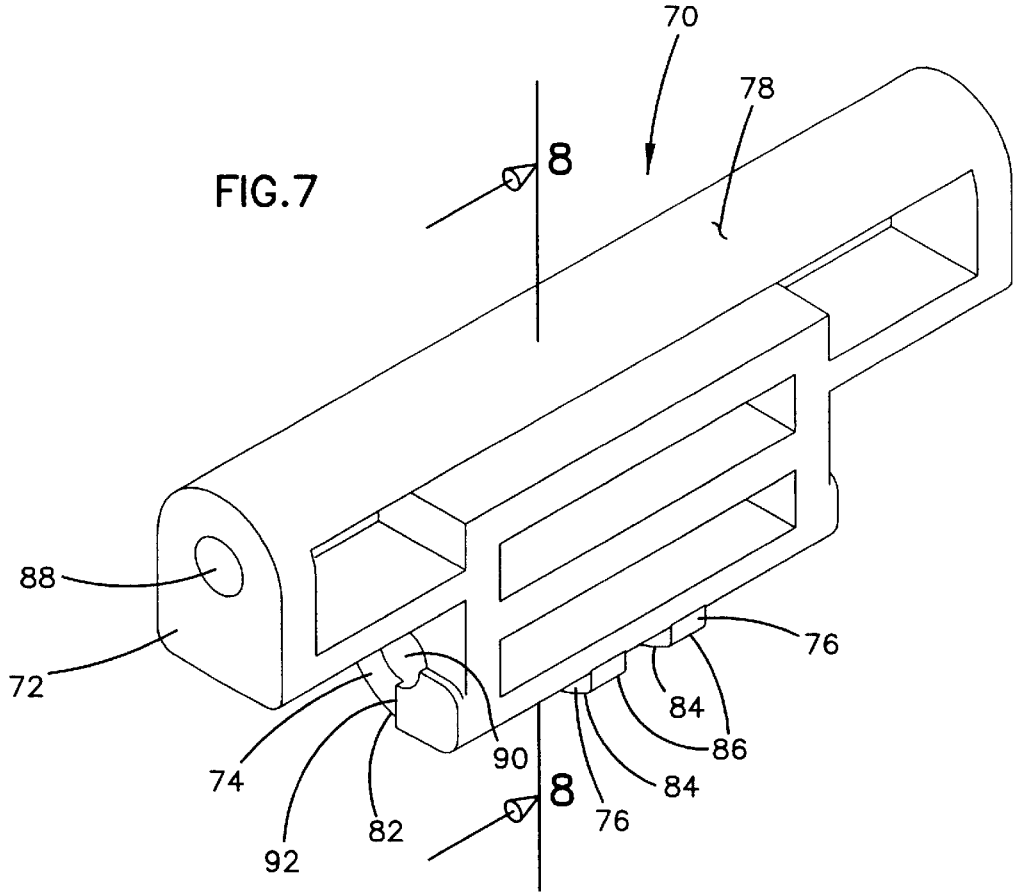
FIG. 7 shows a perspective view of a second link for the hinge shown in FIG. 1 complementary to the link shown in FIG. 5.
Figure 8:
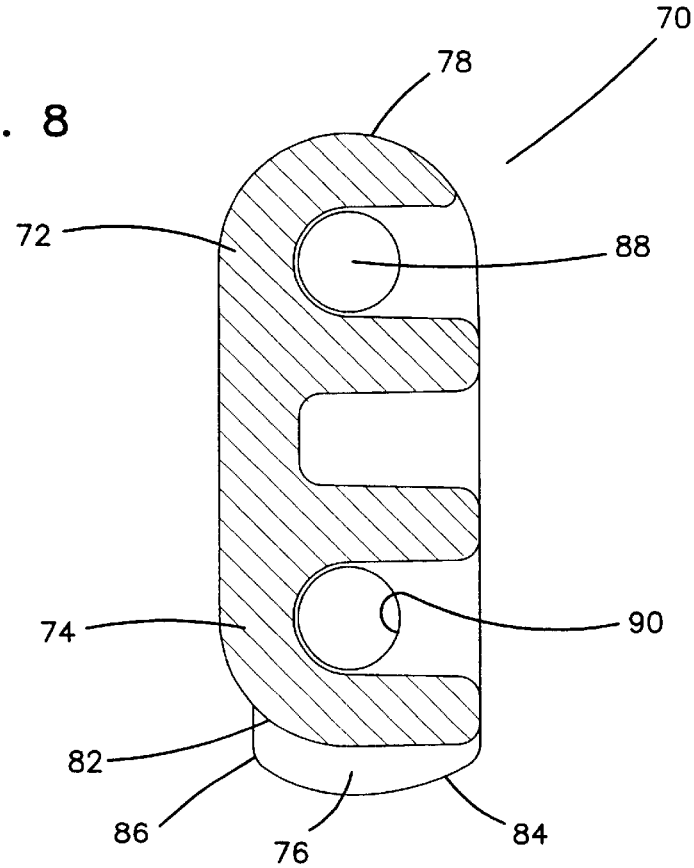
FIG. 8 shows a sectional view of the second link taken along line 8—8 of FIG. 7.

Referring to FIG. 7, a second link member 70 is shown that is configured for pivotally mounting, as shown in FIGS. 1–4, to the door 26 and the first link member 50. The second link member 70 includes a second knuckle 72, third knuckles 74 and lug portions 76. The second knuckle 72 includes a bore 88 formed therethrough and is configured to receive a hinge pin 28 for pivotally mounting to the cover 26. The second knuckle 72 includes an arcing surface 78 to provide clearance during rotation relative to the cover 26. Ends of the second knuckle 72 include stop portions 92 of approximately 90 degrees. The radial end surfaces of the stops 92 are complementary to and cooperate with the ends of the stop portions 56. Referring again to FIG. 7, third knuckles 74 include an arcing outer surface 82 providing for rotation relative to the base 52 of the first link member 50. The third barrel 74 also includes a bore 90 receiving a hinge pin for connection to the first knuckle 54 of the first link member 50. Extending downward from the lower portion of the third barrel 74 are the lugs 76. The lugs 76 include a camming surface 84 forming a corner 86. The lugs 76 are spaced and configured for inserting into the recesses 60 on the first link member 50. The second link member 70 is aligned relative to the first link member 50 by the corner portion 86 of the lugs 76 engaging the corresponding stop fingers 62. The rotation can be accomplished by the lugs 76 pushing against the stop members 62 until the fingers 62 flex and allow rotation. The camming surface 84 rotates, sliding against the flexed associated stop finger 62.

Referring again to FIG. 1, with the compound hinge 22 in the closed position, the cover 26 is shut against the housing 24 so that the gasket 44 presses against the ridge 32 of the collar 30 to form a seal. The second link 70 is in a substantially vertical position with the camming surface 84 of the lug 76 resting against the lug engaging surfaces 60. The corners 86 of the lugs 76 rest against the stop finger 62 of the first link member 50.

The radially extending ends of the stop portions 92 of the second knuckle 72 of the second link member 70 cooperate with the corresponding stop portions 56 of the first link member 50 to prevent further rotation in the clockwise direction, as taken from the end view in FIG. 1.

As the cover 26 is opened, the cover 26 rotates relative to the second link member 70, which remains stationary from the closed position. The resistance of the fingers 62 engaging the lugs 76 prevents rotation of the second link member 70 relative to the first link member 50 while the cover 26 rotates with less resistance.

The cover 26 reaches its maximum range of motion relative to the second link member 70 at approximately 180 degrees of travel by the outer edge of the recessed portion 46 of the cover 26 engaging the outer side of the second link 70. Further rotation of the cover 26 relative to the second link member 70 is not possible so that in normal use, the cover 26 tends to stay at the position shown in FIG. 2. Further rotational force applied to the cover 26 tends to rotate the second link member 70 in a counter clockwise direction, as shown in FIG. 2. This pressure causes a torque around the hinge pin 28 extending through the first and second knuckles, applying pressure against the fingers 62. As the lugs 76 push the fingers 62 and cause the fingers 62 to flex out of the way, the hinge 20 passes through a toggle point until the cover 26 reaches the position shown in FIG. 3. This provides approximately a 270 degree range of motion. At the position shown in FIG. 3, the cover 26 is substantially parallel to and extending along the edge of the housing 24 so that there can be almost no effect from wind catching the door and closing it.

When the cover 26 is closed, the stop fingers 62 are again pushed by the lugs 76, but in the opposite direction and resist clockwise rotation, as shown in FIG. 4. However, the door 26 is free to rotate above the axis of rotation passing through the second knuckle 72 and rotate back to the position shown in FIG. 4. The cover 26 rests against the side of the second link 70 and further rotation of the cover 26 relative to the second link member 70 is not possible. In addition, the fingers 62 resist rotation so that the door will not close until additional pressure is applied and the fingers 62 are forced to flex by the lugs 76. As the fingers 62 flex to the right as viewed in FIGS. 1–4, the lugs 76 can travel back to the position shown in FIG. 1 and the cover 26 is again closed.

However, the additional resistance needed to flex the fingers 62 provides slightly increased resistance so that the cover 26 stays in the open position without the additional force to overcome the resistance being applied.

Referring to FIGS. 13–19, there is shown a second embodiment of a compound hinge, generally designated 120, in accordance with the principles of the present invention. The compound hinge 120 is similar to the hinge 20, except that a toggle device 180 is added to provide more rotational resistance for holding the hinge in a predetermined position. The toggle device 180 includes a recess 182 formed in a first knuckle 154 of a first hinge member 150, and a second knuckle 172 of a second hinge member 170. The arcing periphery of the first knuckle 154, or the complementary surface of the second knuckle 172, includes a raised flange portion 184 which is configured for extending partially into a complementary recess 182 in the other of the first knuckle 154 or second knuckle 174 at the toggle position.

Figure 19:
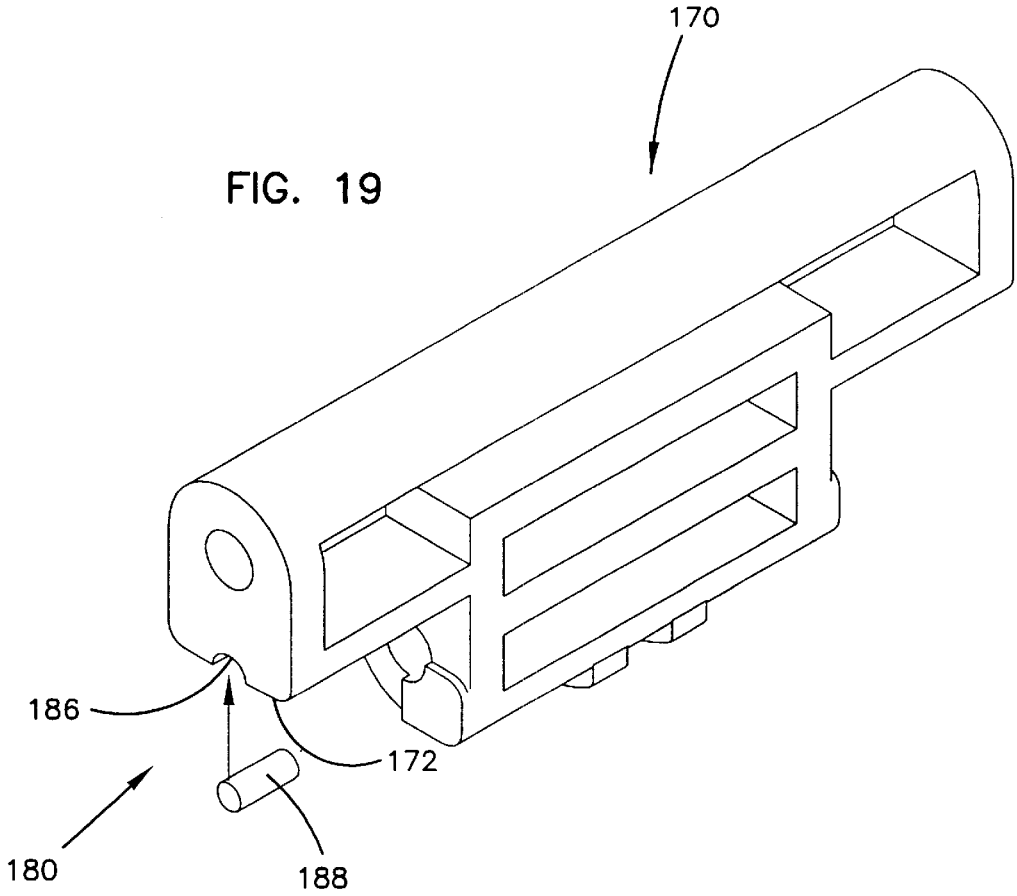
FIG. 19 shows a perspective view of the second link for the hinge shown in FIG. 13 complementary to the link shown in FIG. 16 with a pin element replacing a flange portion.
Figure 18:
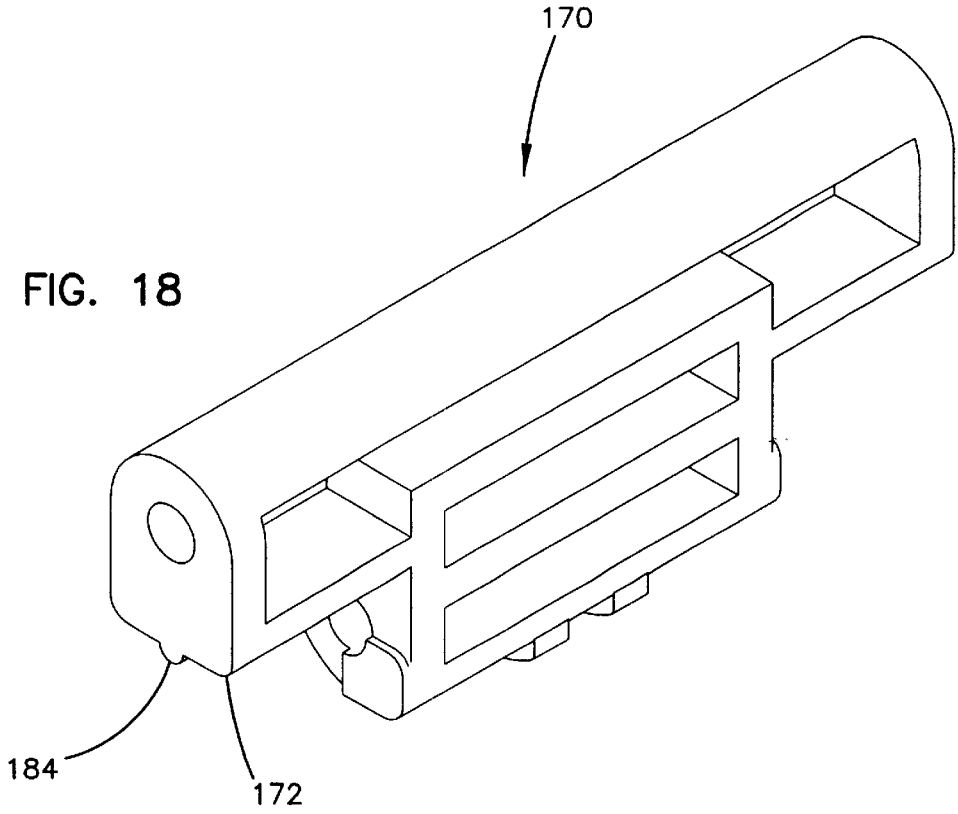
FIG. 18 shows a perspective view of a second link for the hinge shown in FIG. 13 complementary to the link shown in FIG. 16.

When the toggle device 180 is engaged, as shown in FIGS. 13 and 14, the first and second knuckles 154 and 172 have greater resistance to relative rotation. As the cover 26 is rotated about the second hinge member 170, the first and second knuckles 154 and 172 have a mechanical stop which prevents the first hinge member 150 and second hinge member 170 from rotating relative to one another. Further rotation requires slightly more effort to disengage the toggle assembly 180 and allow rotation between the first hinge member 150 and the second hinge member 170. As shown in FIG. 18, the flange portion 184 may be molded into the second knuckle 172. In addition, as shown in FIG. 19, the second knuckle 172 may include a recess 186 with a pin member 188 extended into both the recess 182 and the recess 186. As with the flange 184, the pin member 188 also provides resistance and the same toggle effect. The toggle assembly 180 provides proper resistance so that the hinge 120 may be held in a predetermined position. Although the toggle assembly 180 is shown at the apex of the first knuckle 154, it can be appreciated that, if a toggle position is required at a different location along the range of rotation, it may be easily moved. In addition, the recess 182 and raised portion 184 may be reversed while still achieving the desired toggle effect.

The design of the present invention provides a simple hinge mechanism that allows a 270 degree range of motion. In addition, the collar 30 and hinge 20 or 120 provide for retrofitting enclosures to accept such a system. The system also has rotation about a two different axes and fingers that act as a stop member that prevents the door from swinging closed without force sufficient to cause flexure of the fingers 62. Since the cover 26 rotates about an axis remote from the enclosure housing 24, the cover does not rub the gaskets, so that a better and longer seal is maintained.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in that the appended claims are expressed.

What is claimed is:

1. A hinge, pivotally connecting a second element to a first element, the hinge comprising:

a first link, adapted to be mounted to the first element;

a second link adapted to be pivotally mounted to the second element and pivotally mounted to the first link;

wherein the first and second links form a preselected first toggle point, wherein the first and second links pivot about a first axis and the second link and second element pivot about a second axis, wherein the hinge pivots about the second axis for a portion of a pivoting range of motion, and wherein after passing through the first toggle point, the hinge pivots about the first axis.

2. A hinge according to claim 1, wherein the first link member includes a resilient finger portion adapted to flex when engaging the second link member at the first toggle point.

3. An enclosure, comprising:

a housing;

a cover adapted to fit over the housing;

a first hinge member mounted to the housing;

a second hinge member rotatably mounted to the cover and to the first hinge member;

wherein the first and second hinge members cooperate to move the cover between an open position and a closed position, wherein the first and second hinge members form a preselected toggle point and the hinge rotates about a first axis, and wherein after passing through the toggle point as the cover is moved between the open and closed positions, the hinge rotates about a second axis.

4. An enclosure according to claim 7, wherein the first and second hinge members are molded.

5. An enclosure according to claim 3, wherein the enclosure includes a gasket and wherein the hinge spaces the cover apart from the gasket, wherein the cover rotates about a first axis spaced apart from the gasket, so that the cover does not rub against the gasket during rotation.

6. A pivoting system having a first element pivoting relative to a second element, comprising:

a first link and a second link, the second link having a second knuckle and third knuckle to extend parallel to the second knuckle and having a lug with a camming surface;

the first link having a complementary surface receiving the camming surface and a stop surface, a first knuckle adapted for axial alignment with the third knuckle;

a first pin inserting through the first and third knuckles;

a second pin inserting into the second element and the second knuckle;

wherein the second link includes a resilient flexing portion, and wherein the lug engages the flexing portion to form a toggle point and moves the flexing portion upon relative pivoting between the first and second link members, and wherein the flexing portion returns to an unflexed position after the hinge passes through the toggle point.

7. A system according to claim 6, wherein the second link comprises a pair of lugs and the first link comprises a pair of the complementary surfaces.

8. A system according to claim 6, wherein the first link comprises a pair of spaced apart coaxial first knuckles.

9. A system according to claim 8, wherein the third knuckle is adapted for insertion intermediate the first knuckles.

10. A hinge according to claim 1, wherein one of the first and second link members includes a raised flange, and the other of the first and second link members defines a channel portion configured for engaging the flange in the closed position, wherein the flange comprises a pin, and wherein the one of the first and second link members defines a recess receiving the pin wherein the flange and the recess are spaced radially outward from and extend substantially parallel to an axis of rotation between the first and second link members and define a second toggle as the flange engages and disengages the channel.

11. A hinge according to claim 1, wherein the first link includes a resilient finger flexing only at the first toggle point and wherein the finger returns to an unflexed state when the hinge is rotated to a position before and beyond the first toggle point.

12. A hinge according to claim 11, wherein the first link comprises a base and wherein the finger portion is formed in the base.

13. A hinge according to claim 1, wherein the first toggle point is on the first axis and further comprising a second toggle point on the second axis.

14. A hinge according to claim 6, wherein the first axis, second axis and lugs are coplanar.

15. An enclosure, comprising:

a housing;

a cover adapted to fit over the housing;

a first hinge member mounted to the housing including a resilient flange;

a second hinge member rotatably mounted to the cover and to the first hinge member;

wherein the second hinge member has a second knuckle, and a third knuckle extending parallel to the second knuckle and having a lug with a camming surface; and the first hinge member having a complementary surface receiving the camming surface and a stop surface, a first knuckle adapted for axial alignment with the third knuckle;

and wherein the first and second hinge members cooperate to move the cover between an open position and a closed position, wherein the lug and the flange form a preselected toggle point, and wherein the hinge rotates about a first axis, and after passing through the toggle point as the cover is moved between the open and closed positions, the hinge rotates about a second axis.

16. An enclosure according to claim 15, wherein the first axis, second axis and lug lie in a first plane.

17. An enclosure according to claim 16, wherein the first plane is perpendicular to a plane of the cover.

18. A hinge according to claim 10, wherein the first link member comprises a knuckle and the second link member comprises a knuckle, and wherein the flange is formed in one of the knuckles and the channel is formed in the other of the knuckles.

19. A hinge, pivotally connecting a second element to a first element, the hinge comprising:

a first link, adapted to be mounted to the first element;

a second link adapted to be pivotally mounted to the second element and pivotally mounted to the first link;

wherein the first and second links form a preselected toggle point, wherein the first and second links pivot about a first axis, and the second link and the second element pivot about a second axis, wherein the hinge pivots in a first direction about the second axis, and wherein after passing through the toggle point, the hinge pivots about the first axis; and wherein the hinge pivots in a second direction about the second axis; and wherein after passing through the toggle point, the hinge pivots about the first axis.

20. A hinge, pivotally connecting a second element to a first element, the hinge comprising:

a first link, adapted to be mounted to the first element;

a second link adapted to be pivotally mounted to the second element and pivotally mounted to the first link;

wherein the first and second links form a preselected toggle point, wherein the first and second links pivot about a first axis, and the second link and the second element pivot about a second axis, wherein the hinge pivots in a first direction about the second axis for a first portion of a pivoting range of motion, and wherein after passing through the toggle point, the binge pivots about the first axis for a second portion of the pivoting range of motion; and wherein the hinge pivots in a second direction about the second axis for a third portion of the pivoting range of motion; and wherein after passing back through the toggle point, the hinge pivots about the first axis for a fourth portion of the pivoting range of motion.

21. A hinge according to claim 20, wherein the first portion of the pivoting range of motion is greater than the second portion of the pivoting range of motion.

22. A hinge according to claim 21, wherein the third portion of the pivoting range of motion is greater than the fourth portion of the pivoting range of motion.

23. A hinge according to claim 20, wherein the toggle point occurs at a first position when rotating in the first direction and at a second position when rotating in the second direction.

24. A hinge according to claim 20, wherein the toggle point occurs at about 180 degrees of rotation when rotating in the first direction.

25. A hinge according to claim 24, wherein the toggle point occurs at about 180 degrees of rotation when rotating in the second direction.

26. A hinge according to claim 20, wherein the hinge pivots through a total range of motion of about 270 degrees.

27. A hinge, pivotally connecting a second element to a first element, the hinge comprising:

a first link, adapted to be mounted to the first element;

a second link adapted to be pivotally mounted to the second element and pivotally mounted to the first link;

wherein the first and second links form a preselected toggle point, wherein the first and second links pivot about a first axis, and the second link and the second element pivot about a second axis, wherein the second element pivots in a first direction about the second axis for a first portion of a pivoting range of motion, and wherein after passing through the toggle point, the second link pivots about the first axis for a second portion of the pivoting range of motion; and wherein the second element pivots in a second direction about the second axis for a third portion of the pivoting range of motion; and wherein after passing through the toggle point, the second link pivots about the first axis for a fourth portion of the pivoting range of motion.

28. An enclosure, comprising:

a housing;

a cover adapted to fit over the housing;

a first hinge member mounted to the housing;

a second hinge member including a lug and rotatably mounted to the first hinge member about a first axis and to the cover about a second axis;

wherein the first and second hinge members cooperate to move the cover from a closed position to an open position, wherein the first and second hinge members form a preselected toggle point, and wherein the cover rotates about the second axis, and after passing through the toggle point as the cover is moved from the closed position to the open position, the second hinge member rotates about the first axis;

and wherein the first and second hinge members cooperate to move the cover from an open position to a closed position, and wherein the cover first rotates about the second axis, and after passing through the toggle point as the cover is moved from the open position to the closed position, the second hinge member rotates about the first axis.

29. An enclosure according to claims 28, wherein the toggle point occurs at a first position when rotating in the first direction and at a second position when rotating in the second direction.

* * * * *